US010337176B2

(12) United States Patent
Stoelzel et al.

(10) Patent No.: US 10,337,176 B2
(45) Date of Patent: Jul. 2, 2019

(54) PLUMBING FITTING HAVING A WATER-CONDUCTING HOSE

(71) Applicant: Grohe AG, Hemer (DE)

(72) Inventors: Uwe Stoelzel, Menden (DE); Matthias Schlueter, Dortmund (DE); Torsten Meier, Duesseldorf (DE)

(73) Assignee: Grohe AG, Hemer (DE)

( * ) Notice: Subject to any disclaimer, the term of this patent is extended or adjusted under 35 U.S.C. 154(b) by 141 days.

(21) Appl. No.: 15/262,664

(22) Filed: Sep. 12, 2016

(65) Prior Publication Data

US 2017/0073943 A1 Mar. 16, 2017

(30) Foreign Application Priority Data

Sep. 11, 2015 (DE) ..... 10 2015 011 658

(51) Int. Cl.
*E03C 1/04* (2006.01)
*E03C 1/08* (2006.01)

(52) U.S. Cl.
CPC ..... *E03C 1/0404* (2013.01); *E03C 1/08* (2013.01); *Y10T 137/9464* (2015.04)

(58) Field of Classification Search
USPC ..... 137/801; 4/675–678; 285/46, 58; 251/148
See application file for complete search history.

(56) References Cited

U.S. PATENT DOCUMENTS 5,669,417 A * 9/1997 Lian-Jie ..... E03C 1/0404 137/606
8,061,386 B2 * 11/2011 Mueller ..... E03C 1/0404 137/801
8,185,984 B2 * 5/2012 Meehan ..... E03C 1/0401 137/801
8,430,345 B2 * 4/2013 Esche ..... E03C 1/0404 137/801
8,899,259 B2 * 12/2014 Jonte ..... E03C 1/0402 137/315.12
9,551,136 B2 * 1/2017 Keiter ..... E03C 1/0404

FOREIGN PATENT DOCUMENTS

DE 10 2012 014 947 A1 1/2014
WO WO 2009/158497 A1 12/2009

* cited by examiner

*Primary Examiner* — Robert K Arundale
*Assistant Examiner* — Daphne M Barry
(74) *Attorney, Agent, or Firm* — Muncy, Geissler, Olds & Lowe, P.C.

(57) ABSTRACT

A plumbing fitting that includes a housing having an outlet, water being conductible through the outlet from a hose connection to a jet former of the outlet with the aid of a hose. The hose being insertable into an outlet nipple of the hose connection, and the outlet nipple having a groove extending from an opening in which a seal is disposed for the purpose of sealing the housing against the outlet nipple. The groove being at least partially closed by a closing element disposed on an end face of the outlet nipple.

13 Claims, 2 Drawing Sheets

PLUMBING FITTING HAVING A WATER-CONDUCTING HOSE

This nonprovisional application claims priority under 35 U.S.C. § 119(a) to German Patent Application No. 10 2015 011 658.4, which was filed in Germany on Sep. 11, 2015, and which is herein incorporated by reference.

BACKGROUND OF THE INVENTION

Field of the Invention

The present invention relates to a plumbing fitting, which is used, in particular, to provide a mixed water having a desired mixed-water temperature. Plumbing fittings of this type are regularly used in sanitary facilities in connection with washbasins and/or sinks.

Description of the Background Art

Plumbing fittings are known, which include a housing and an outlet, which are at least partially made of brass. Drinking water comes into contact with the brass hereby, so that components of the brass may accumulate in the drinking water. However, this is undesirable from a health standpoint. For this reason, plumbing fittings have been proposed which contain a hose for conducting the water. These hoses may be connected to the water-conducting housing, e.g., by means of a retaining cartridge or by being mounted on an outlet nipple. Due to this construction, the outlets must thus be provided with a comparatively wide design, in particular if they are to additionally implement a pivot angle limitation for the outlet. For example, pins or raised areas might be mounted on the end face of the outlet, which are guided in a groove introduced into the housing and whose ends form a stop. In addition, a stud bolt, which is mounted orthogonally to the pivot axis of the outlet, may be provided to implement the pivot angle limitation, whose end is guided in a radially introduced groove.

The conventional designs consequently do not facilitate a slim design of the plumbing fitting. In the case of maintenance, for example when replacing the hose, many components must furthermore be disassembled, whereby the maintenance becomes very complex. These designs also have a large number of sealing points, which increase the risk of leaks.

SUMMARY OF THE INVENTION

It is therefore an object of the invention is therefore to at least partially solve the problems described with respect to the prior art and, in particular, to specify a plumbing fitting which may be provided with a slim design, is easy to maintain, and/or which has only a small number of sealing points.

In an exemplary embodiment, a plumbing fitting is provided that includes a housing having an outlet, water being conductible through the outlet from a hose connection to a jet former of the outlet with the aid of a hose, the hose being insertable into an outlet nipple of the house connection. The outlet nipple has a groove, starting from an opening, in which a seal is disposed for sealing the hose against the outlet, and the groove is at least partially closed by a closing element disposed on an end face of the outlet nipple.

The exemplary plumbing fitting provides a mixed water having a desired mixed water temperature according to the requirements. Plumbing fittings of this type are regularly used in connection with washbasins and/or sinks. For this purpose, the plumbing fitting may include a mixer cartridge or a mixing valve in a housing, with the aid of which a cold water having a cold water temperature and a hot water having a hot water temperature are mixable to form a mixed water having the mixed water temperature. The mixer cartridge and/or the mixing valve may be actuated, in particular, with the aid of at least one lever of the plumbing fitting. The cold water temperature is preferably 0-40° C. (Celsius) and/or the hot water temperature is 40-80° C. The housing has, in particular, an at least partially tubular design and may be fastened to a carrier, for example a worktop or a washbasin or sink. The plumbing fitting furthermore has an outlet, which is, in particular, rotatably fastened to the housing. With the aid of the hose, water is conductible through the outlet from a hose connection to a jet former of the outlet. The hose is, in particular, a plastic hose. In particular, plastics such as polyethylene (PET) are suitable for hoses of this type. Plastic of this type have a high strength, are food-safe and thus particularly suitable for use in plumbing fittings for dispensing water. The jet former is, in particular, an aerator.

This prevents the water from coming into contact with the outlet, whereby less expensive materials which are not approved for drinking water may be used to manufacture the outlet. In particular, the complete plumbing fitting is constructed in such a way that no contact is established between the water and the housing or the outlet. As a result, the water is completely isolated from the brass of the plumbing fitting, and the plumbing fitting may thus comply with all drinking water regulations. As an additional advantage, a plumbing fitting of this type may be used as a "non-allergenic fitting." A reduction in the number of variants may also be achieved, because it is not necessary to take into account the use of different brass materials.

The hose is insertable into an outlet nipple of the hose connection for the purpose of connecting the hose connection to the jet former. The outlet nipple is, in particular, a bore or a cylindrical recess of the hose connection, whose inner diameter essentially corresponds to an outer diameter of the hose. The outlet nipple may also be provided with an at least partially tubular design. The hose is insertable into the outlet nipple, preferably at least 20 mm (millimeters) deep, particularly preferably at least 40 mm deep or exceptionally preferably at least 60 mm deep. This ensures that the hose may not be pulled out of the outlet nipple by hammering of the water and by warping of the hose in the outlet to the extent that leaks occur. The outlet nipple has a groove, extending from an opening, through which the hose is insertable into the outlet nipple. The groove extends from the opening in the outlet nipple, preferably 5 mm to 20 mm in a longitudinal direction of the outlet nipple. A seal is disposed in the groove for the purpose of sealing the hose against the outlet nipple. The seal is, in particular, at least one O ring. In addition, the groove is at least partially closed by a closing element disposed on an end face of the outlet nipple. In other words, the closing element at least partially closes the opening in the outlet nipple. The closing element may have a bore through which the hose extends. Moreover, the closing element is preferably not disposed in the groove. The closing element may be a stop nipple. The at least partial closure of the groove by the closing element prevents, in particular, the seal from coming out of the groove. Due to the proposed design of the plumbing fitting, a maintenance of the plumbing fitting may take place with a small amount of work, as a result of a small number of components. In addition, the hose connection has only one seal for sealing the hose, whereby a risk of leaks is reduced, due to only one single sealing point.

It is furthermore advantageous if the closing element is mounted on a spline toothing. The spline toothing is disposed, in particular, on a peripheral surface of the outlet nipple. Due to the spline toothing, the closing element is rotatably fixedly connectable to the outlet nipple. The closing element has, in particular, an approximately C-shaped cross-sectional surface for this purpose, on whose inner surface a spline toothing is also at least partially formed. The spline toothing of the closing element and the spline toothing of the outlet nipple engage with each other in such a way that the closing element is rotatably fixedly fastened to the outlet nipple relative to the outlet nipple. The spline toothing permits a freely selectable pivot position of the outlet, which is independent of a position of the plumbing fitting. Instead of a spline toothing, another form-fitting connection between the outlet nipple and the closing element may be provided, which is suitable for preventing or purposefully setting a rotation of the closing element around a longitudinal direction of the outlet nipple.

It is furthermore advantageous if the closing element is fixed in place by the outlet. This means, in particular, that the closing element is held in place by the outlet on the end face of the outlet nipple or the opening of the outlet nipple.

It is also advantageous if the closing element is designed in the manner of a cover. This means, in particular, that the closing element at least partially surrounds a peripheral surface of the outlet nipple.

It is furthermore advantageous if the closing element has a first stop and a second stop, between which a stop of the outlet or a solder sleeve is pivotable in a first gap. The first stop is designed, in particular, in the manner of a first cam, and the second stop is designed, in particular, in the manner of a second cam. The first cam and the second cam extend, in particular, from a face of the closing element in the longitudinal direction. The first stop and the second stop are oriented, in particular, in a circumferential direction of the closing element. A first gap, which defines a pivoting range of the outlet, is formed between the first stop and the second stop. A stop of the outlet, or a solder sleeve of the outlet, engages with the gap and is pivotable therein up to the first stop and the second stop. For this purpose, the first gap is preferably designed to be bigger than the stop. By displacing the closing element within the spline toothing, the pivot angle may thus be adjusted in coordination with the alignment of the plumbing fitting.

It is also advantageous if a second gap, in which the stop is fixable, is formed between the first stop and the second stop (additionally outside the first gap). By correspondingly aligning the closing element on the spline toothing, for example by rotating it by 180°, stop may be inserted into or engage with the second gap, so that the outlet is fixed in place and thus has no pivot angle. The second gap and stop preferably have an essentially congruent size for this purpose.

It is also advantageous if the outlet is fastened to the housing with the aid of a fastening component. The fastening component may be, for example, a clamp, a screw and/or a pin. In the case of a (pretensioned) clamp, the latter may engage, in particular, with an inner groove of the outlet. The outlet is secured hereby against pulling away from the housing.

It is furthermore advantageous if the outlet has a stop, which acts as a hold-down device for the closing element.

If is also advantageous if the stop extends radially inwardly from an inner side of the housing.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
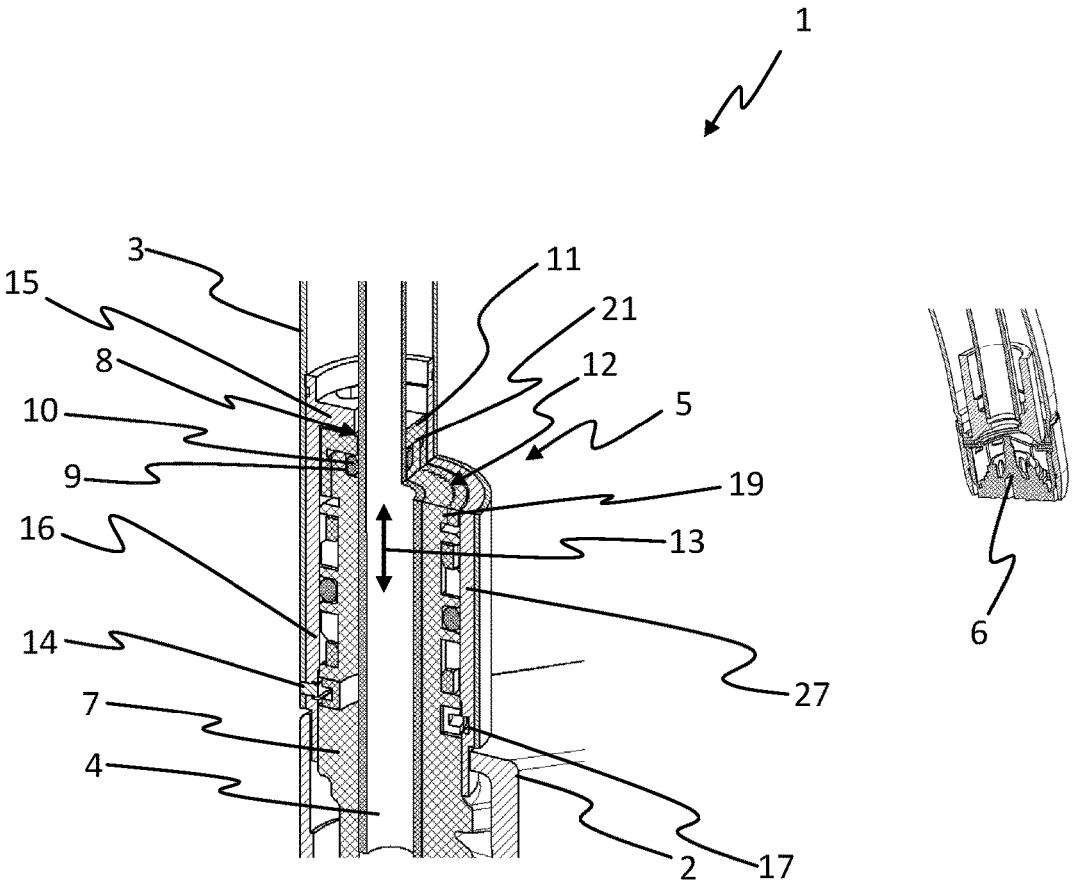
FIG. 1 shows a sectional representation of a plumbing fitting.

FIG. 1 shows a sectional representation of a plumbing fitting 1, including a housing 2 and an outlet 3. In this case, housing 2 is fastened to a carrier, which is not illustrated, which may be a worktop or a washbasin or sink. Outlet 3 is mounted on housing 2 and fastened with the aid of a fastening component 14, designed in the manner of a clamp, which engages with an inner groove 17 of outlet 3. To prevent water dispensed by plumbing fitting 1 from coming into contact with the outlet, plumbing fitting 1 has a hose 4, with the aid of which water is conductible from a hose connection 5 to a jet former 6. Hose connection 5 includes an outlet nipple 7, which is provided with an at least partially tubular design and which extends in a longitudinal direction 13. Hose 4 is inserted into outlet nipple 7 through an opening 8 of outlet nipple 7. A groove 9 extends from opening 8 in the direction of longitudinal direction 13 of outlet nipple 7. A seal 10, which seals hose 4 against outlet nipple 7 and which is an O ring in this case, is disposed in this groove 9. In this exemplary embodiment, opening 8 is completely closed by a closing element 11 disposed on an end face 21 of outlet nipple 7. For this purpose, hose 4 extends through closing element 11. Closing element 11 is rotationally symmetrical and designed in the manner of a cover. Closing element 11 is furthermore mounted on a spline toothing 12, which is formed on a peripheral surface 19 of outlet nipple 7. Closing element 11 is rotatably fixedly connected hereby to outlet nipple 7. Outlet 3 also has a stop 15, which extends radially inwardly from an inner side 16 of outlet 3. It prevents closing element 11 from becoming detached, due to a form fit.

Figure 2:
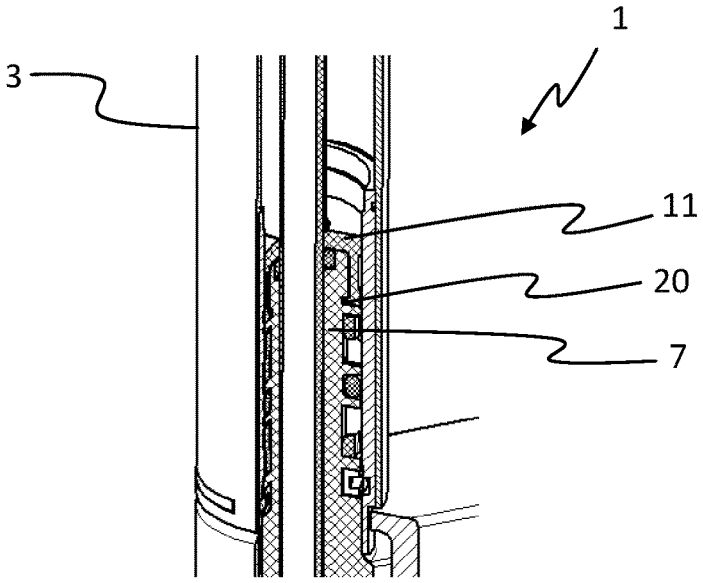
FIG. 2 shows a partial sectional view of a second design variant of a plumbing fitting.

FIG. 2 shows a sectional representation of a second design variant of plumbing fitting 1. The second design variant differs from the first design variant of plumbing fitting 1 illustrated in FIG. 1 only in that closing element 11 is fastened to outlet nipple 7 by a latching hook 20. In addition, outlet nipple 7 and closing element 11 do not have a spline toothing 12. As a result, the second exemplary embodiment of plumbing fitting 1 does not have a pivot angle limitation of outlet 3.

Figure 3:
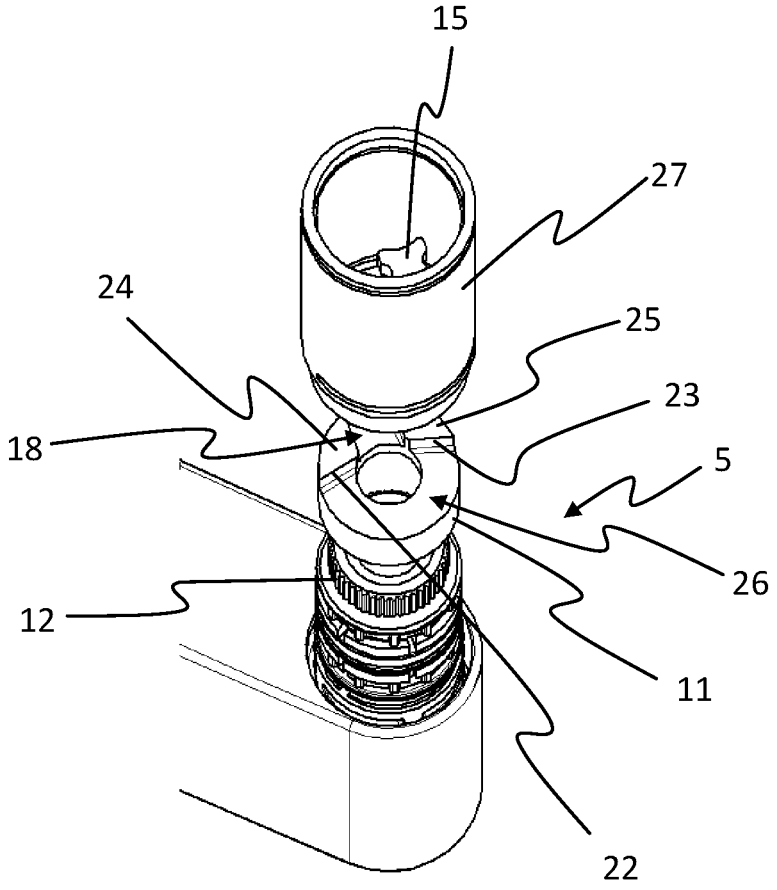
FIG. 3 shows a perspective representation of a hose connection.

FIG. 3 shows a perspective representation of a hose connection 5, as used in the first and second design variants of plumbing fitting 1. It is apparent here, in particular, that closing element 11 has a first stop 22 and a second stop 23 on its face. First stop 22 is formed by a first cam 24 and second stop 23 is formed by a second cam 25. A first gap 26, which defines a pivoting range of outlet 3, which is not shown here, is defined between first stop 22 and second stop 23. Stop 15 of outlet 3, or a solder sleeve 27 of outlet 3, engages with gap 26 and is pivotable therein up to first stop 22 and second stop 23. For this purpose, first gap 26 is designed to be bigger than stop 15. In this case, stop 15 is formed on solder sleeve 27 and extends radially inwardly from solder sleeve 27. By displacing closing element 11 within spline toothing 12, the pivot angle may thus be set independently of the alignment of plumbing fitting 1. Closing element 11 furthermore has a second gap 18 between first stop 22 and second stop 23. By correspondingly aligning closing element 11 to spline toothing 12, for example by rotating it by 180°, stop 15 may be inserted into or engage with second gap 18, so that outlet 3 is fixed in place and thus has no pivot angle. Second gap 18 and stop 15 preferably have an essentially congruent size for this purpose.

Due to an exemplary embodiment of the present invention, a plumbing fitting may be provided with a particularly slim design. The plumbing fitting is also easy to maintain and has a small number of sealing points.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A plumbing fitting comprising:

a hose connection;

an outlet nipple; and a housing having an outlet, water being conductible through the outlet from the hose connection to a jet former of the outlet with the aid of a hose, wherein the hose is insertable into the outlet nipple of the hose connection, wherein the outlet nipple has a groove extending from an opening in which a seal is disposed for sealing the hose against the outlet nipple, wherein the groove is at least partially closed by a closing element disposed on an end face of the outlet nipple, wherein the seal is wedged between an inner wall of the groove and an exterior wall of the hose, such that the seal directly abuts both the inner wall of the groove and the exterior wall of the hose, and wherein the closing element has a first stop and a second stop, between which a stop of the outlet or a solder sleeve is pivotable in a first gap.

2. The plumbing fitting according to claim 1, wherein the closing element is mountable on a spline toothing.

3. The plumbing fitting according to claim 2, wherein the spline toothing extends in a longitudinal direction of the outlet nipple.

4. The plumbing fitting according to claim 2, wherein the spline toothing is formed in a peripheral surface of the outlet nipple.

5. The plumbing fitting according to claim 1, wherein the closing element is fixed in place by the outlet.

6. The plumbing fitting according to claim 1, wherein the closing element is a cover.

7. The plumbing fitting according to claim 1, wherein a second gap, in which the stop is fixable, is formed between the first stop and the second stop.

8. The plumbing fitting according to claim 1, wherein the outlet is fastened to the housing via a fastening component.

9. The plumbing fitting according to claim 1, wherein the end face of the outlet nipple has the opening, such that the opening of the outlet nipple extends through the end face, and wherein the groove of the outlet nipple is recessed from the end face.

10. The plumbing fitting according to claim 1, wherein the groove opens into the opening of the outlet nipple.

11. The plumbing fitting according to claim 1, wherein the first stop and the second stop protrude in a same direction from a same surface of the closing element.

12. A plumbing fitting comprising:

a hose connection;

an outlet nipple; and a housing having an outlet, water being conductible through the outlet from the hose connection to a jet former of the outlet with the aid of a hose, wherein the hose is insertable into the outlet nipple of the hose connection, wherein the outlet nipple has a groove extending from an opening in which a seal is disposed for sealing the hose against the outlet nipple, wherein the groove is at least partially closed by a closing element disposed on an end face of the outlet nipple, wherein the seal is wedged between an inner wall of the groove and an exterior wall of the hose, such that the seal directly abuts both the inner wall of the groove and the exterior wall of the hose, and wherein the outlet has a stop that prevents the closing element from being detached from the end face of the outlet nipple.

13. The plumbing fitting according to claim 12, wherein the stop extends radially inwardly from an inner side of the housing.

* * * * *